US006786947B2

(12) United States Patent
Mountford

(10) Patent No.: US 6,786,947 B2
(45) Date of Patent: Sep. 7, 2004

(54) WASHABLE CLOTH VACUUM CLEANER FILTER BAG HAVING A RESEALABLE OPENING FOR EMPTYING VACUUMED DEBRIS

(76) Inventor: Robin A. Mountford, 30 W. Lake View Way, Woodland Hills, UT (US) 84653

( * ) Notice: Subject to any disclaimer, the term of this patent is extended or adjusted under 35 U.S.C. 154(b) by 0 days.

(21) Appl. No.: 10/321,051

(22) Filed: Dec. 16, 2002

(65) Prior Publication Data

US 2004/0112019 A1 Jun. 17, 2004

(51) Int. Cl.[7] ..... B01D 46/02

(52) U.S. Cl. ..... 55/367; 55/369; 55/377; 55/379; 55/DIG. 2; 493/186; 493/214

(58) Field of Search ..... 55/367, 369, 377, 55/379, 385.3, DIG. 2, 374, 381, DIG. 3; 493/186, 214; 15/347

(56) References Cited

U.S. PATENT DOCUMENTS 2,435,490 A * 2/1948 Beager et al. ..... 55/DIG. 2
3,297,233 A * 1/1967 Meyerhoefer ..... 55/DIG. 2
3,634,905 A * 1/1972 Boyd ..... 55/DIG. 2
3,755,993 A * 9/1973 Cote ..... 55/DIG. 2
6,007,594 A 12/1999 Kaczor
6,071,322 A * 6/2000 Hulthen ..... 55/DIG. 2

* cited by examiner

*Primary Examiner*—Blaine Copenheaver
*Assistant Examiner*—Minh-Chau T. Pham
(74) *Attorney, Agent, or Firm*—Angus C. Fox, III

(57) ABSTRACT

A washable cloth vacuum cleaner filter bag for use on wet/dry vacuum cleaners and in central vacuum cleaner systems includes a first opening for receiving vacuumed debris, means for attaching the first opening to the inlet of the vacuum cleaner or system, and a second opening, which is reversably sealable, for removing the vacuumed debris from the bag. In combination with the bag, the vacuum cleaner or system may be successfully used to suction up fine particulate debris, including gypsum dust and MDF dust. For a preferred embodiment of the new vacuum cleaner filter bag, the bag, which is of generally rectangular shape, is fabricated from a tight weave, synthetic-fiber cloth having a warp of about 160 threads per inch and a weft of about 68 threads per inch. A variety of fastener types may be employed for the reversably sealable second opening. The second opening incorporates a cuff on one side of the opening which is turned inside out to fold over the edge of the other side of the bag.

20 Claims, 3 Drawing Sheets

WASHABLE CLOTH VACUUM CLEANER FILTER BAG HAVING A RESEALABLE OPENING FOR EMPTYING VACUUMED DEBRIS

BACKGROUND OF THE INVENTION

1. Field of the Invention

This invention relates to bags used for collecting debris that is collected by a vacuum cleaner and, more specifically, to reusable cloth bags which may be used to collect fine particulate matter.

2. Description of the Prior Art

Typical central vacuum cleaner systems and portable wet/dry vacuum cleaners have a large collection canister with an inlet near the top thereof. All of the rigid vacuum lines within a house or building having a single central vacuum cleaner system converge to this inlet. For a wet/dry vacuum cleaner, a flexible hose may generally be attached to this inlet. A top canister cover typically incorporates a motor and filter assembly. For a wet/dry vacuum cleaner, a foam filter may be used for suctioning up liquids, or a paper filter may be used when picking up dry debris. As central vacuum cleaner systems are generally designed to pick up only dry debris, the filter on those systems is typically either paper or cloth. Typically, filter surface area on both central vacuum cleaner systems and wet/dry vacuum cleaners is rather limited. When picking up coarse dry debris, the paper or cloth filters function quite well, as the average particle size is much greater than the pore size of the paper filter or cloth filter. However, when suctioning up fine particulate detrius, such as gypsum dust or fine sawdust, the filter will clog and become virtually worthless—often within only seconds. As the pore size of the paper is very close to the size of the individual debris particles, each pore becomes irreversably clogged. Even back-flow air pressure may be incapable of unclogging the pores:of a paper filter. As each paper filter generally costs $10 to $20, the use of a central vacuum cleaner system or a wet/dry vacuum cleaner to pick up fine particulate debris can be very expensive and equally futile. Not only are the filters at risk under these conditions, but so are the electric motors. Because the motors of central vacuum cleaner systems and wet/dry vacuum cleaners rely on air flow to cool their powerful, high-amperage electric motors, a serious restriction or blockage of the airflow will result in overheating and concomitant destruction of the motor. As some central vacuum cleaner systems have multiple motors, a clogged filter can easily result a pair of damaged motors and hundreds of dollars in repair costs.

SUMMARY OF THE INVENTION

In accordance with the present invention, a new reusable and washable cloth vacuum cleaner filter bag is provided which solves the problems heretofore described. According to one aspect of the present invention, the new vacuum cleaner filter bag includes a first opening for receiving vacuumed debris, means for attaching the first opening to the tubular inlet of the wet/dry vacuum cleaner or central vacuum cleaner system, and a second opening, which is reversably sealable, for removing the vacuumed debris from the bag. A cloth filter bag, fabricated in accordance with the present invention, has been successfully used to suction up fine particulate debris, including gypsum dust and medium density fiberboard (MDF) dust. Particulate debris of these types will generally clog the filters of wet/dry vacuum cleaners and those of central vacuum cleaner systems very quickly. For a preferred embodiment of the new vacuum cleaner filter bag, the bag is fabricated from a tight weave, synthetic-fiber cloth having a warp of about 130 to 160 threads per inch and a weft of about 56 to 68 threads per inch. A synthetic cloth made of smooth filament fibers, such as nylon, rayon, polyester or polypropylene is deemed to be preferable to those made of fibers which are not smooth, as the cloth may be more easily cleaned. Rough fibers tend to trap dust particles, while smooth fibers tend to release them when agitated in a detergent solution. A variety of fastener types may be employed for the reversably sealable second opening. Hook and loop fasteners (of which the Velcro® brand fasteners are an example), compression-fit zip fasteners, and zipper fasteners and substitutes therefor are contemplated.

For one embodiment of the invention, the cloth filter bag is of generally rectangular shape having the first opening centered along the top edge thereof. The first opening incorporates a neck, by means of which the bag may be secured with an adjustable clamp to the inlet of the vacuum system. The entire lower edge of the bag incorporates the second opening, which is reversably sealable. The lower edge of the bag is constructed much like a polyethylene sandwich bag. That is to say that a cuff is made by folding back the cloth on one side of the opening and seaming the cuff at the lateral edges thereof. A first portion of the fastener is sewn or bonded to the face of the cuff, while the mating second portion of the fastener is sewn or bonded to the opposite opposing edge of the cloth on the other side of the bag. In order to seal the second opening of the bag, the cuff is turned inside out so that the face of the first fastener portion overlaps the second portion of the fastener, thereby allowing the two fastener portions to be sealably engaged. This arrangement is advantageous because the cuff can be returned to its original conformation after the second opening is unsealed, thereby permitting the bag to be emptied without the debris coming in contact with either fastener portions. This is particularly important where the fastener is of the hook and loop type. If such a fastener were in the path of the debris when the bag was emptied, the fastener could be easily fouled by debris particles. In addition, by folding the cuff over the opening when it is turned inside out, the opening is covered by filter cloth so that fastener is not directly exposed. If a hook and loop fastener were used to close the end of a bag having no cuff, the fastener material would be more likely to breathe, resulting in particulate debris being sucked through the fastener.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof. In the drawings.

DESCRIPTION OF THE PREFERRED EMBODIMENT

In accordance with the present invention, a new reusable and washable cloth vacuum cleaner filter bag is provided for use with vacuum cleaner systems having a tubular inlet within a debris collection tank. Typically, such vacuum cleaner systems are either wet/dry vacuum cleaners or central vacuum cleaner systems. As is typical of most, if not all, vacuum cleaner systems, during system operation, air pressure is reduced below ambient atmospheric pressure so that debris may be pneumatically suctioned from outside the tank, through an inlet, into the debris collection tank.

Figure 1:
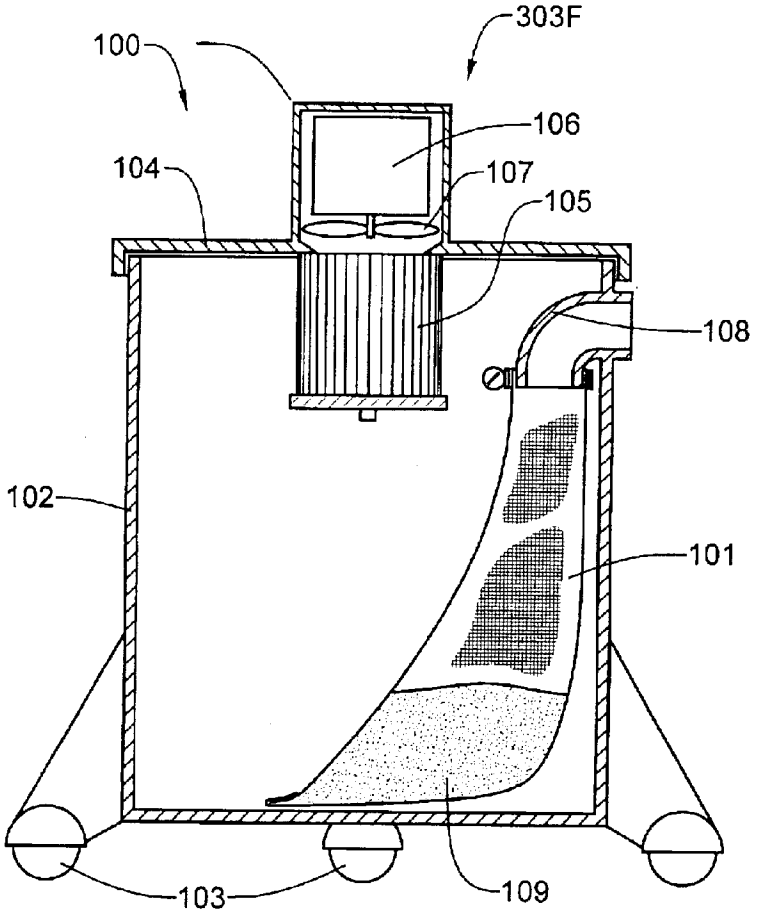
FIG. 1 is a diagrammatic cut-away view of a typical wet/dry vacuum cleaner having a washable filter bag fabricated in accordance with the present invention.

Referring now to the drawings, which are for purposes of illustrating a preferred embodiment of the invention only and not for purposes of limiting the same, FIG. 1 shows a diagrammatic cut-away view of a wet/dry vacuum cleaner 100 having installed therein a washable filter bag 101 fabricated in accordance with the present invention. The wet/dry vacuum cleaner 100 has a generally cylindrical debris collection tank 102, to which are attached a plurality of casters 103 which facilitate movement of the machine. The vacuum cleaner 100 has a top cover assembly 104 which seals a circular opening at the top of the tank 102. The top cover assembly 104 incorporates a replaceable filter 105, an electric motor 106 and a fan 107 which is driven by the motor. The fan 107, when spinning at high speed, creates air pressure within the tank that is lower than ambient atmospheric pressure. As a result of this lowered pressure within the tank 102, debris may be suctioned from outside the tank 102 through an inlet pipe 108 into the tank 102. Without the filter bag 101 installed the inlet pipe 108, debris would ordinarily collect within the tank 102, itself. However, with the filter bag 101 in place, as shown, the debris is collected within the bag 101. The cloth, from which the bag 101 is fabricated is tightly woven so that it traps debris particles 109, yet sufficiently porous and having sufficient surface area to permit the passage of air without significant restriction.

Figure 2:
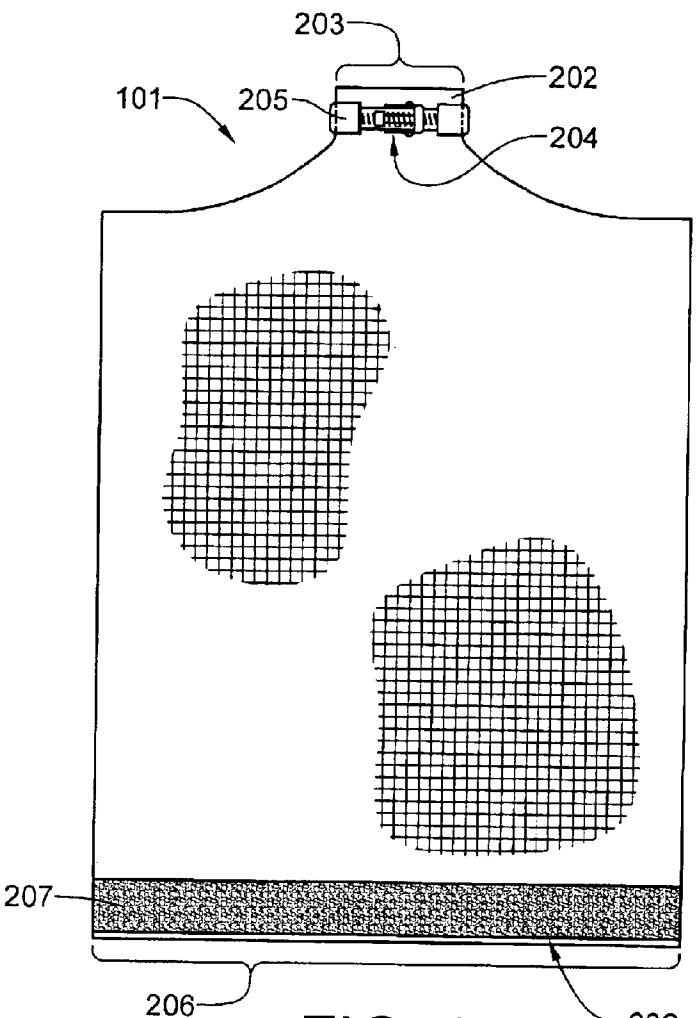
FIG. 2 is a front elevational view of a first embodiment of the washable filter bag, which employs a hook and loop fastener system to reversably seal the second opening.

Referring now to the front view of FIG. 2, the new washable filter bag 101, prior to installation and prior to being filled with debris, is generally rectangularly shaped. The top 201 of the bag 101 tapers to a neck 202 which incorporates a first opening 203, through which vacuumed debris is received into the bag 101. The first opening 203 may be secured to the inlet pipe of a wet/dry vacuum cleaner or central vacuum cleaner system with an adjustable hose clamp 204, which is inserted through a circumferential sleeve 205 in the neck 202. Other similar equivalent attachment devices may be utilized in place of the hose clamp 204 which include, without limitation, a looped coil spring, an elastomeric band, or an elastomeric belt. A second opening 206 extends the entire width of the bottom of the bag. A strip of either hook or loop material (in this example, loop material 207 is shown) is sewn or bonded to the edge 208 of the opening 206.

Figure 3:
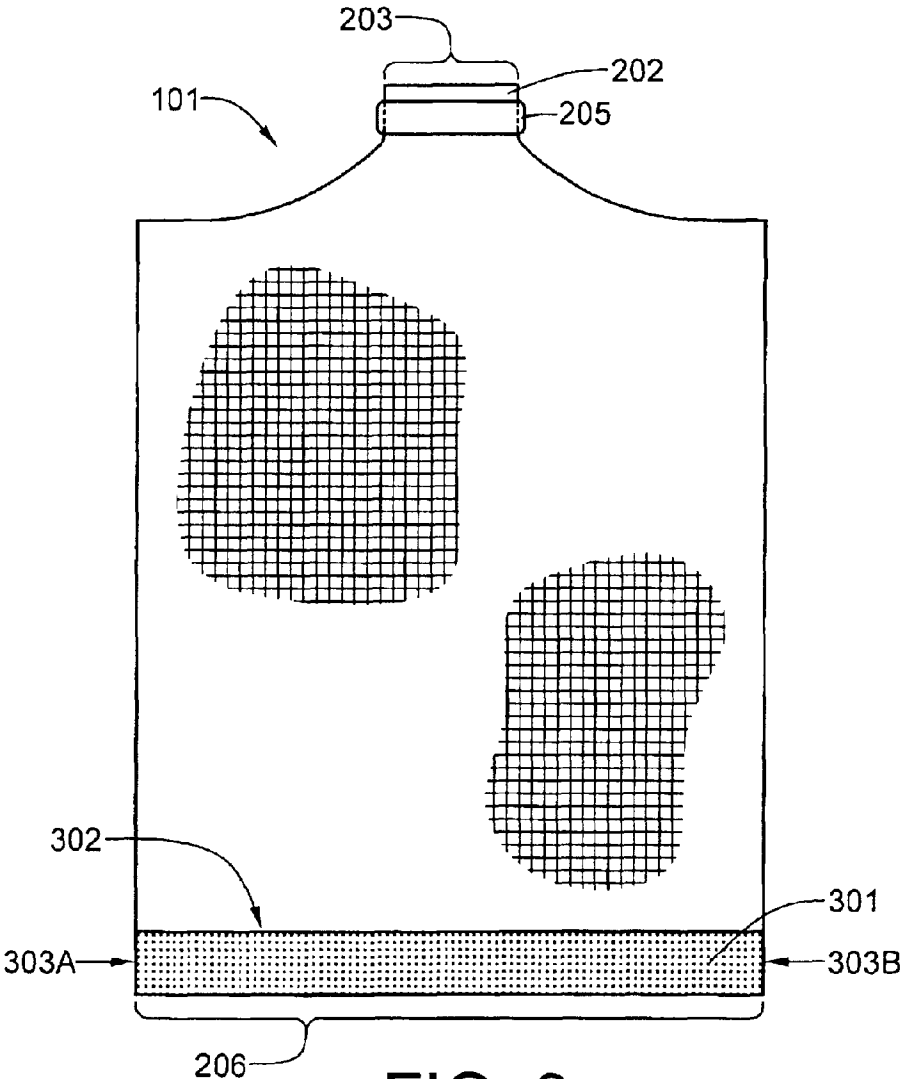
FIG. 3 is a rear elevational view of the washable filter bag of FIG. 2.

Referring now to the rear view of FIG. 3, the washable filter bag 101 appears much the same as in FIG. 2, except that the second opening 206 is not visible in this view. Instead, a strip of either hook or loop material (in this example, hook material 301 is shown) is sewn or bonded to a cuff 302, which is upwardly open along the line 303. The cuff 302 is seamed at the side edges 303A and 303B of the bag 101.

Figure 4:
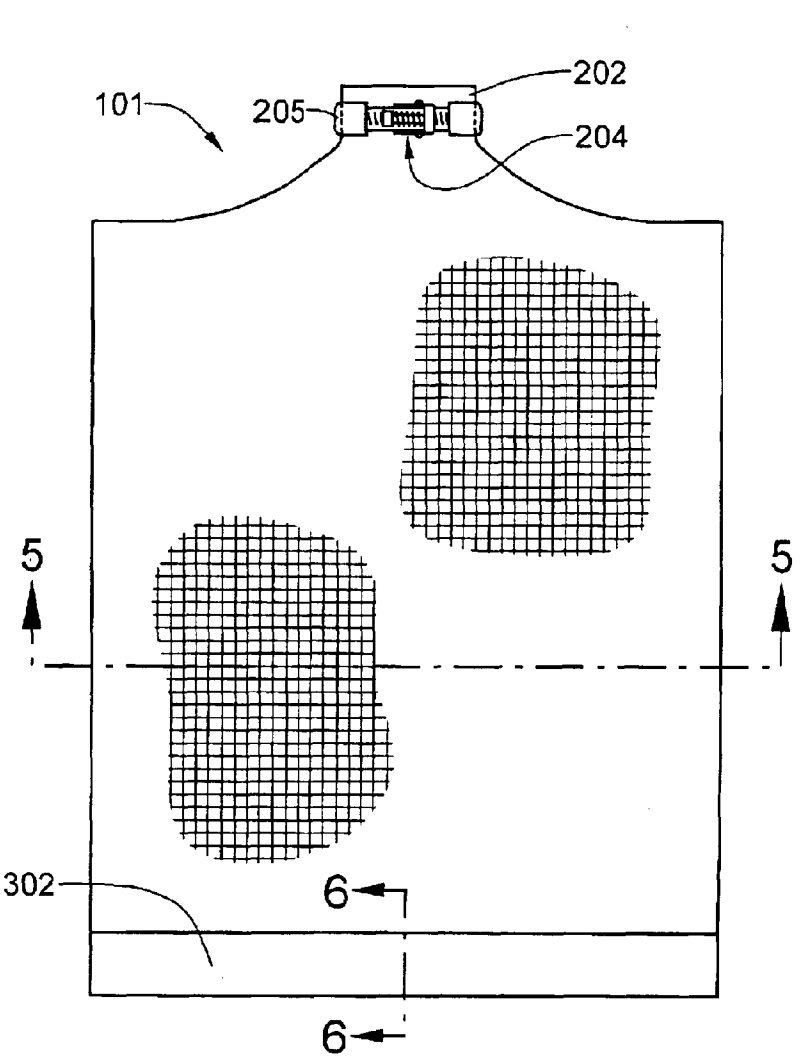
FIG. 4 is a front elevational view of the washable filter bag of FIG. 2 after the cuff has been turned inside out to cover the lower edge of the opposide side of the bag.

Referring now to the front view of FIG. 4, the cuff 302 shown in FIG. 3 has been turned inside out so that it is now folded over the second opening 206 shown in FIG. 2. With the cuff 302 folded over the second opening 206, the strip of hook material 301 is in contact with the strip of loop material 207. By pressing the two two strips together, the second opening 206 is effectively sealed. The folding of the cuff 302 over the second opening 206 helps prevent the passage of debris particles through the fastener system which, in this case, consists of hook and loop fastener strips. An added advantage of this configuration is that once the second opening 206 is reopened by pulling the hook and loop fastener strips apart, the cuff 302 may be returned to its original configuration as shown in FIG. 3. In this manner, the filter bag 101 may be emptied without the debris particles coming into contact with and fouling the hook and loop material sealing strips 301 and 206, respectively. The reversable cuff 302 is, thus, considered to be a significant, non-obvious aspect of the invention, as it provides improved sealing of the second opening 206 and allows the filter bag 101 to be emptied without fouling the strips used to seal the second opening 206.

Figure 5:
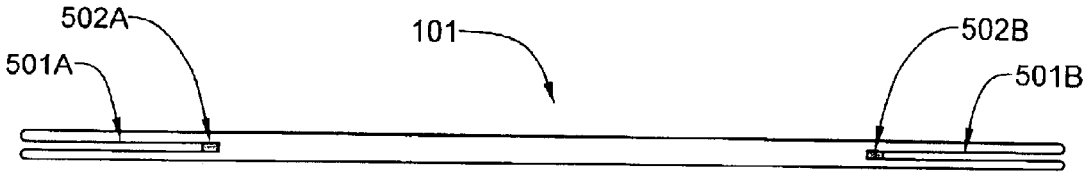
FIG. 5 is a cross-sectional view through section line 5—5 of FIG. 4.

Referring now to cross-sectional view of FIG. 5, it will be noted that the bag has been fabricated so that folded pleats 501A and 501B are incorporated in sides thereof. For a preferred embodiment of the filter bag 101, the cloth is seamed at locations 502A and 502B. As the filter bag 101 fills, the pleats 501A and 501B expand to increase the volume of the bag 101.

Figure 6:
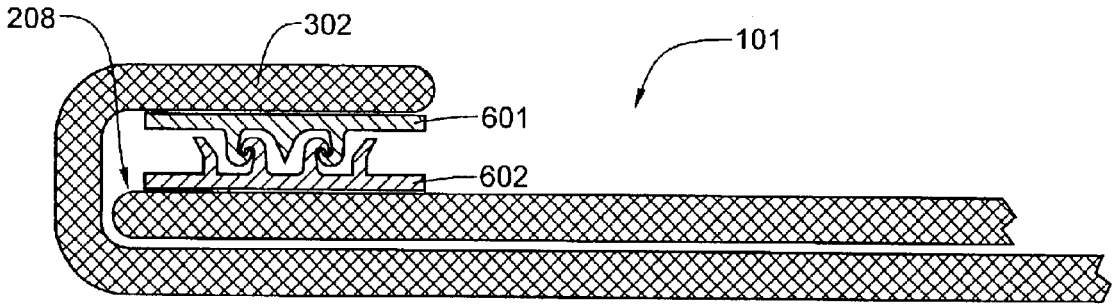
FIG. 6 is a cross-sectional view through section line 6—6 of FIG. 4 showing a zip-type fastener system for reversably sealing the second opening.

Referring now to FIG. 6, an alternative zip fastener sealing mechanism is shown in cross-section. The hook and loop sealing strips 301 and 206 of FIGS. 2 and 3 have been replaced by a pair of interlocking zip fastener sealing strips 601 and 602, which are extruded from a flexible polymeric plastic material. Zip sealing strips, such as those of the Zip-Loc® brand are the most well known. The zip fastener strips 601 and 602 are sewn, heat seamed or bonded to either the outer surface of the cuff 302 or to the edge of the second opening 206.

Figure 7:
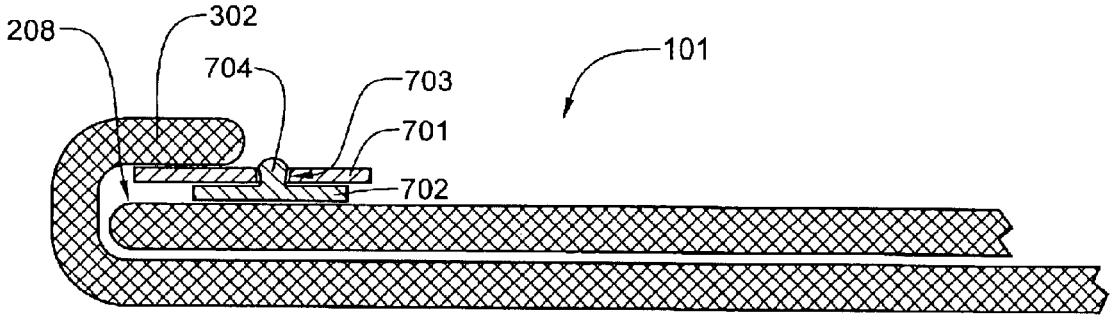
FIG. 7 is a cross-sectional view through section line 6—6 of FIG. 4 showing a single snap of a linear snap array fastener system for reversably sealing the second opening.

Referring now to FIG. 7, an alternative sealing mechanism is shown. The hook and loop sealing strips 301 and 206 of FIGS. 2 and 3 have been replaced by a pair of strips 701 and 702, which incorporate a linear snap array. In this cross-sectional view, only a single snap, consisting of a female snap portion 703 and a male snap portion 704, is shown. Each of the snap strips 701 and 702 may be molded from flexible polymeric plastic material and may be sewn, heat seamed, or otherwise bonded to either the outer surface of the cuff 302 or to the edge of the second opening 206.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. A vacuum cleaner filter bag for use with an associated vacuum cleaner system having a debris collection tank with an inlet through which debris is received via pneumatic force from a hose or a network of interconnected pipes outside said tank, said inlet terminating as a tube extending from a wall of the tank into the interior thereof, said vacuum cleaner filter bag comprising:

a cloth bag having a first opening securable to the tube, and a second opening formed by a pair of generally parallel, neighboring first and second unseamed-together edges of mutually-facing expanses of cloth, said second opening extending the entire length of said first and second edges, said first edge incorporating a cuff which, when not turned inside out, faces away from said second edge and incorporates a first sealing strip along its entire length, said second edge incorporating a second sealing strip along its entire length that is generally positioned back-to-back with respect to said first sealing strip, such that when said cuff is turned inside out, it overlaps said first edge with said first and second sealing strips being in intimate sealing contact with one another.

2. The vacuum cleaner filter bag of claim 1, which further comprises a neck interposed between said first opening and a major portion of said bag, said neck incorporating a partially circumferential sleeve sized to receive an adjustable clamp.

3. The vacuum cleaner filter bag of claim 1, wherein said first and second sealing strips are, alternately, hook and loop fastener material.

4. The vacuum cleaner filter bag of claim 1, wherein said first and second sealing strips are mateable, extruded flexible polymeric zip fasteners.

5. The vacuum cleaner filter bag of claim 1, wherein said first and second sealing strips are mateable, molded polymeric linear snap array strips.

6. The vacuum cleaner filter bag of claim 1, wherein the cloth from which it is made is washable and woven from synthetic polymeric fibers.

7. The vacuum cleaner filter bag of claim 6, wherein said synthetic polymeric fibers are selected from the group consisting of nylon, rayon, polypropylene, and polyester.

8. The vacuum cleaner filter bag of claim 7, wherein the cloth has a warp range of about 51 to 63 threads per centimeter (approximately 130 to 160 threads per inch) and a weft range of about 22 to 27 threads per centimeter (approximately 56 to 68 threads per inch).

9. The vacuum cleaner filter bag of claim 1, wherein said first opening is positioned at an upper end of said bag, and said second opening is positioned at a lower end thereof.

10. The vacuum cleaner filter bag of claim 1, which further comprises a pair of opposite sides, each of which incorporates a folded pleat for increased bag volume.

11. A vacuum cleaner filter bag for use with an associated vacuum cleaner system having a debris collection tank in which, during operation of the system, air pressure is reduced below ambient atmospheric pressure so that debris may be suctioned from outside the tank through an inlet into the tank, said inlet terminating as a tubular member inside the tank, said vacuum cleaner filter bag comprising:

a cloth bag having a first opening securable to the tubular member, and a second opening for removing accumulated debris, said second opening being formed by a pair of generally parallel, neighboring first and second unseamed-together edges of mutually-facing expanses of cloth, said second opening extending the entire length of said first and second edges, said first edge incorporating a cuff which, when not turned inside out, faces away from said second edge and incorporates a first sealing strip along its entire length, said second edge incorporating a second sealing strip along its entire length that is generally positioned back-to-back with respect to said first sealing strip, such that when said cuff is turned inside out, it overlaps said first edge with said first and second sealing strips being in intimate sealing contact with one another.

12. The vacuum cleaner filter bag of claim 11, which further comprises a neck interposed between said first opening and a major portion of said bag, said neck incorporating a partially circumferential sleeve sized to receive an adjustable clamp.

13. The vacuum cleaner filter bag of claim 11, wherein said first and second sealing strips are, alternately, hook and loop fastener materials.

14. The vacuum cleaner filter bag of claim 11, wherein said first and second sealing strips are mateable, extruded flexible polymeric zip fasteners.

15. The vacuum cleaner filter bag of claim 11, wherein said first and second sealing strips are mateable, molded polymeric linear snap array strips.

16. The vacuum cleaner filter bag of claim 11, wherein the cloth from which it is made is washable and woven from synthetic polymeric fibers.

17. The vacuum cleaner filter bag of claim 16, wherein said synthetic polymeric fibers are selected from the group consisting of nylon, rayon, polypropylene, and polyester.

18. The vacuum cleaner filter bag of claim 17, wherein the cloth has a warp range of about 51 to 63 threads per centimeter (approximately 130 to 160 threads per inch) and weft range of about 22 to 27 threads per centimeter (approximately 56 to 68 threads per inch).

19. The vacuum cleaner filter bag of claim 11, wherein said first opening is positioned at an upper end of said bag, and said second opening is positioned at a lower end thereof.

20. The vacuum cleaner filter bag of claim 11, which further comprises a pair of opposite sides, each of which incorporates a folded pleat for increased bag volume.

* * * * *